United States Patent [19]

Trubiano

[11] 4,106,626

[45] Aug. 15, 1978

[54] STACKABLE MATERIAL HANDLING CONTAINER

[75] Inventor: Antoine Trubiano, Pointe aux Trembles, Canada

[73] Assignee: Cari-All, Inc., Canada

[21] Appl. No.: 826,961

[22] Filed: Aug. 22, 1977

Related U.S. Application Data

[63] Continuation of Ser. No. 735,510, Oct. 26, 1976, abandoned.

[51] Int. Cl.[2] ..... B65D 21/02; B65D 7/24; B65D 7/20

[52] U.S. Cl. ..... 206/513; 220/19; 220/6

[58] Field of Search ..... 206/513, 511; 220/1.5, 220/6, 7, 19, 324

[56] References Cited

U.S. PATENT DOCUMENTS

| | | | |
|---|---|---|---|
| 3,372,829 | 3/1968 | Averill | 220/6 |
| 3,762,593 | 10/1973 | Beretta | 220/19 X |
| 3,812,999 | 5/1974 | Joseph | 220/19 X |
| 3,917,103 | 11/1975 | Beretta | 220/19 X |
| 4,015,743 | 4/1977 | Beretta | 220/19 |

*Primary Examiner*—William Price
*Assistant Examiner*—Steven M. Pollard
*Attorney, Agent, or Firm*—Charles E. Brown

[57] ABSTRACT

A stackable material handling container comprising a bottom support wall. Opposed pairs of leg members are provided on opposite sides of the bottom support wall, each of the leg members having a support surface spaced downwardly of the bottom support wall and an intermediate bearing surface spaced between the bottom support wall and the support surface. A rigid upstanding wall is secured to a marginal edge of the bottom support wall and extending thereabove across each pair of leg members. Guide means is provided on a top edge of the upstanding wall to position the bearing surface of each of the leg members of a further container in a respective support edge section of the top edge whereby containers may be stacked in alignment one on top of the other.

14 Claims, 11 Drawing Figures

STACKABLE MATERIAL HANDLING CONTAINER

This is a continuation of application Ser. No. 735,510, filed Oct. 26, 1976, now abandoned.

BACKGROUND OF INVENTION (a) Field of the Invention

The present invention relates to a stackable material handling container having leg members permitting many containers in their closed or open condition, to be stacked one on top of each other.

(b) Description of Prior Art

More specifically, the present invention relates to a stackable material handling container having collapsible side walls which are collapsible on a bottom support wall, the container being provided with leg members permitting many of said material handling containers to be stacked one on top of the other with the collapsible side walls collapsed on the bottom wall.

Various types of collapsible material handling containers have been provided for shipping or storing material. A disadvantage of known types of containers is that when the side walls thereof are collapsed, a great many of these are not stackable one on top of the other for storage or shipping. With known containers, it is necessary to position two or three of such collapsed containers on top of the others and then tie them together with rigid strapping means. These containers are fairly heavy and are handled usually by fork lift trucks and often, with these prior art containers, they are damaged as they are not easily picked up by the fork lift truck due to their construction. Also, when these are stacked in a vehicle for shipping, it is very difficult to pile them up, as they are unstable in their packaged form due to the fact that their top surface is not uniform when the side walls are collapsed thereon. This makes them expensive to transport. Also, these are often damaged when positioned one on top of the other as there are no mating bearing surfaces providing clearance of the collapsed side walls with an adjacent container positioned thereover.

Still further disadvantages of the prior art containers are that they are heavy in construction because they comprise rigid steel channel members in the base thereof or the legs are formed from rigid channel members, thus making them difficult to manoeuver. Still further, the channel construction accumulates dirt or other unsanitary deposits therein and such containers cannot be used to support foodstuff unless they are cleaned each time they are utilized. Also, when foodstuff is carried by the contained particles of such foodstuff will accumulate in the channel members and rot, thus constituting an unsanitary container when in use.

A further disadvantage of known containers of the above type is that when the collapsed containers are strapped in bundles of two to four, it is very dangerous to handle them as the package is unstable and when the metal straps are removed, these can snap off in a whipping action sometimes causing injuries. Furthermore, with known type containers, it is difficult to stack them one on top of the other when the containers are in their open or erected position as there is no means to permit alignment of the containers one on top of the other. It is usually required to have a person guide the lift truck operator when a container is positioned on top of the others, particularly if the container stack exceeds eight feet in height. Further, the sequence of folding the walls onto the bottom support wall of the container is difficult and sometimes it is necessary to repeat the sequence a few times before each side wall is properly collapsed when on top of each other in a neat pile.

SUMMARY OF INVENTION

It is a feature of the present invention to provide a stackable material handling container which substantially overcomes all of the above-mentioned disadvantages.

It is a further feature of the present invention to provide a stackable material handling container which is constructed substantially entirely out of metal wire members, thus providing a sanitary container which is easily cleanable and which does not accumulate unwanted material.

A still further feature of the present invention is to provide a stackable and collapsible material handling container having collapsible side walls and permitting a great many of the containers with their collapsed side walls to be stacked one on top of the other in a stable arrangement whereby they can be easily displaced, in a pile, by a fork lift truck, or other means.

A still further feature of the present invention is to provide a stackable material handling container which is easily positioned one on top of each other, when in their open position.

According to the above features, from a broad aspect, the present invention provides a stackable material handling container comprising a bottom support wall. Opposed pairs of leg members are provided on opposite sides of the bottom support wall, each of the leg members having a support surface spaced downwardly of the bottom support wall and an intermediate bearing surface spaced between the bottom support wall and the support surface. A rigid upstanding wall is secured to a marginal edge of the bottom support wall and extending thereabove across each pair of leg members. Guide means is provided on a top edge of the upstanding wall to position the bearing surface of each of the leg members of a further container in a respective support edge section of the top edge whereby containers may be stacked in alignment one on top of the other.

BRIEF DESCRIPTION OF DRAWINGS

A preferred embodiment of the present invention will now be described with reference to the examples illustrated in the accompanying drawings in which.

DESCRIPTION OF PREFERRED EMBODIMENTS

Figure 1:
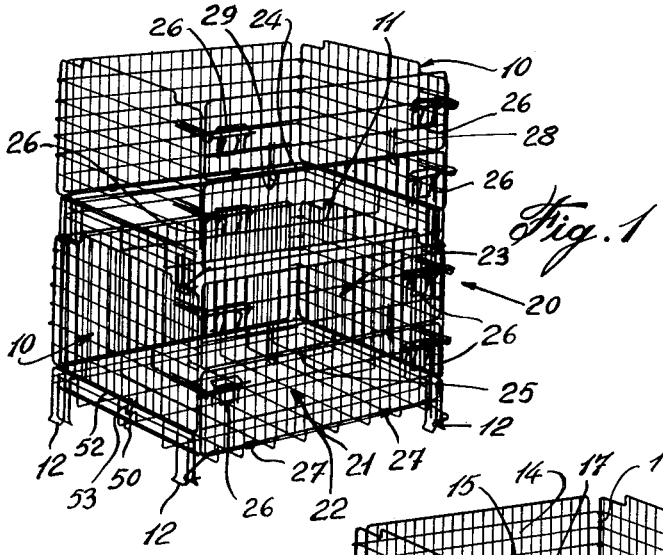
FIG. 1 is a perspective view of the stackable and collapsible material handling container showing a fragmented portion of a further container stacked thereover.

Referring now to the drawings, and more particularly to FIGS. 1 to 4, there is shown generally at 10, the stackable material handling container of the present invention. The container comprises a bottom support wall 11 with opposed pairs of leg members 12 secured to the bottom wall on opposite sides thereof.

As hereinshown, the bottom support wall 11 is of rectangular configuration. A rigid upstanding wall 13 is secured to the marginal edge of the bottom support wall and extends thereabove across at least the pairs of leg members 12. As can be more clearly seen from FIG. 2A, the support walls 13 extend across the end edges of the bottom support wall 11 and the back longitudinal edge. The container hereinshown is formed of structural metal wire members and the rigid upstanding walls 13 are integrally formed with the bottom support wall 11.

Figure 2A:
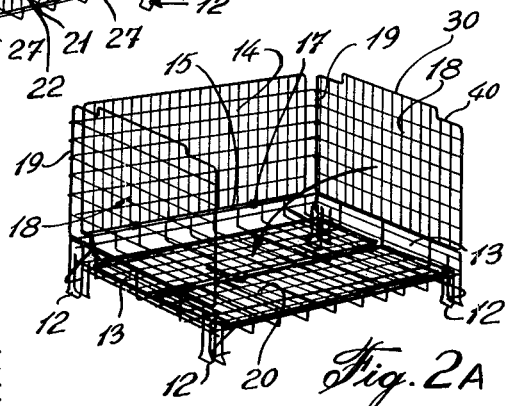
FIGS. 2A, 2B and 2C are perspective views showing the sequence of folding of the side walls onto the bottom wall of the container of the present invention.
Figure 2B:
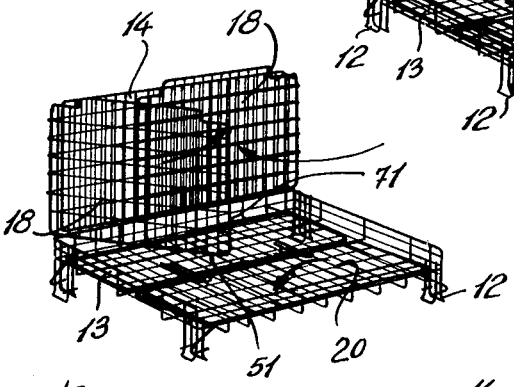
Figure 2C:
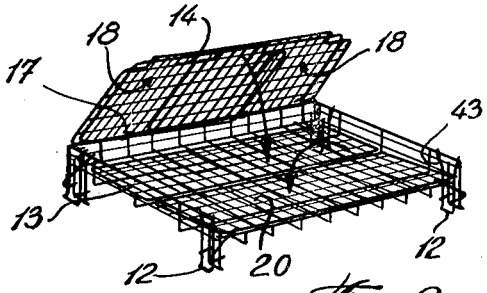

As can be seen more clearly from FIG. 2A, a rear collapsible side wall 14 is hinged at a bottom horizontal edge 15 thereof to a top edge 16 of the upstanding wall 13. The rear collapsible side wall 14 is secured by U-shaped clamp 17 permitting the hinging thereof. Two opposed collapsible side walls 18 are each hinged along a vertical edge 19 to a respective vertical edge of the rear collapsible side wall 14. A front collapsible side wall is hinged at a bottom horizontal edge 21 to a peripheral edge of the bottom support wall 11 opposite and parallel to the bottom horizontal edge of the rear collapsible side wall 14.

As shown in FIG. 1, the front collapsible side wall 20 is provided with a bottom rectangular wall section 22 and a top rectangular wall section 23 hinged along a lower edge 24 to a top edge 25 of the bottom rectangular wall section 22. A connector member 26, constituting a connecting means, is provided adjacent each end edge of the wall sections to connect the front collapsible side wall 20 to the two opposed collapsible side walls 18. The bottom edge of the front side wall 20 is hingeably connected by U-shaped clamps 27. The lower edge of the top wall section and the top edge of the bottom wall section are hingeably connected by a U-shaped hook member 28 having an offset loop 29 whereby the top rectangular wall section will hinge and rest onto said bottom wall section and substantially flat thereon. This will prevent obstruction by the top wall section 23 when in its open position resting in front of the bottom rectangular wall section 22.

The collapsible side walls are all hingeably connected and foldable onto the bottom support wall 11 in the following sequence. Firstly, the entire front wall 20 is collapsed on the bottom support wall 11. Then the side walls 18 are folded onto the back wall 14 and the back wall 14 then folded onto the front wall 20 which is resting on the bottom support wall 11. When all of the collapsible walls are thus folded, there is sufficient clearance above the container to permit a further container 10, having collapsed walls thereon, to be positioned thereover in a stacked arrangement and without obstruction of the folded walls with the underface of the bottom support wall 11 of a container stacked thereover.

Figure 3:
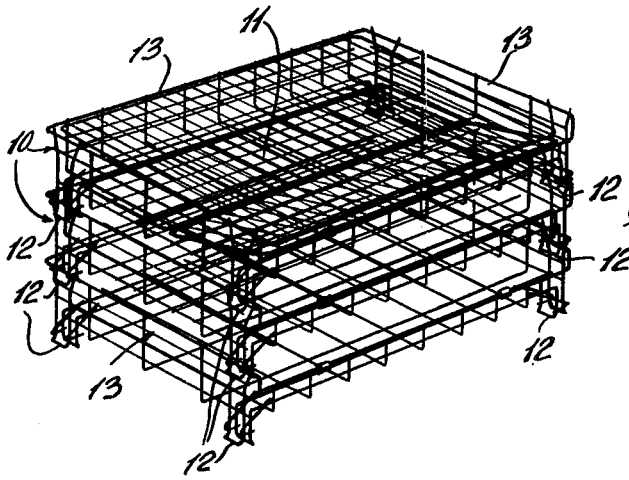
FIG. 3 is a perspective view showing a plurality of containers of the present invention stacked one on top of the other with their side walls collapsed.
Figure 4:
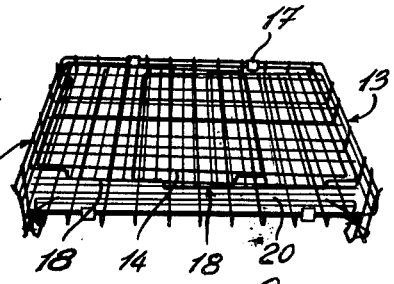
FIG. 4 is a perspective view of the container showing its side walls in the collapsed position, this figure being located out of sequence and appearing on the sheet with FIGS. 7–9.

FIG. 3 illustrates a plurality of such containers stacked on top of each other. Also, there is sufficient clearance under the bottom one of the stacked containers to permit a fork lift truck to easily lift the entire stack. The stacking of the containers one on top of the other is permissible due to the construction of the leg members 12. These containers are prevented from sliding and are easily aligned on top of each other due to the construction of the top edge 30 of the two opposed collapsible side walls 18.

Figure 5:
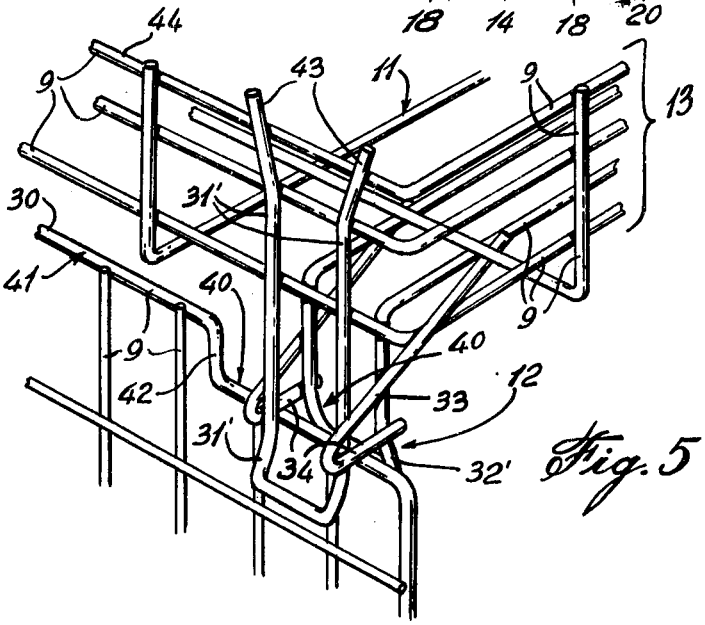
FIG. 5 is a fragmented perspective view showing the leg construction and the stackable arrangement of the container of the present invention.
Figure 6:
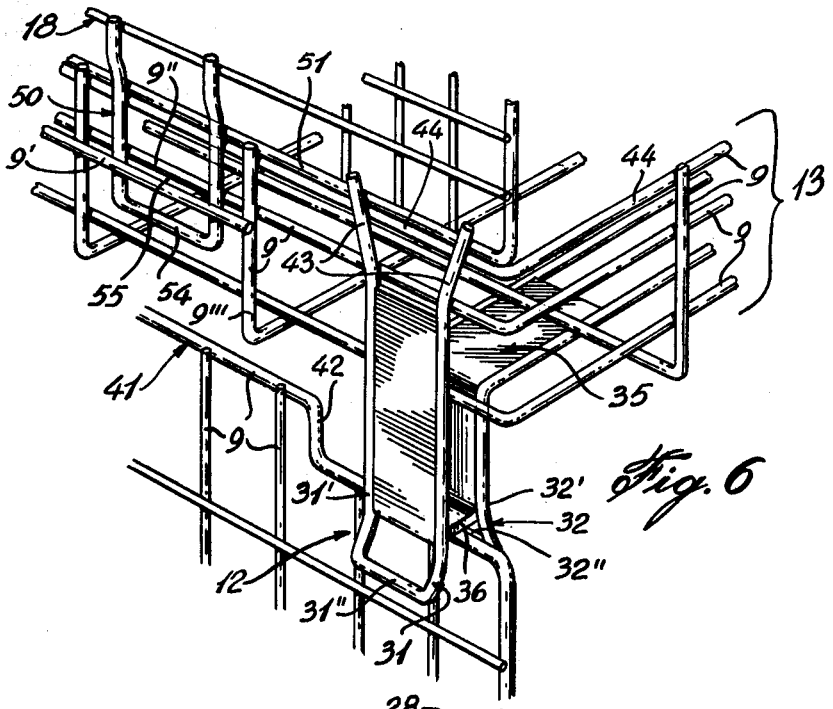
FIG. 6 is a fragmented perspective view showing a modification of the leg construction and the upstanding wall.

Referring now to FIGS. 5 and 6, there is shown the construction of a corner portion of the bottom wall 11 and the upstanding wall 13, all being constructed of structural wire members 9. As shown in these Figures, the leg members 12 comprise two opposed spaced U-shaped wire members 31 and 32 defining side arms 31' and 32' integrally connected at one end to an interconnecting arm 31'' and 32''. The side arms 31' are hereinshown interconnected, by means of welds (not shown) to the structural wire members 9 of the upstanding wall 13. The side arms 32' of the other U-shaped members are connected to the structural wire members 9 of the bottom support wall 11. The interconnecting arms 31'' and 32'' constitute support surfaces to support the bottom wall of the container above a flat support surface.

As shown in FIG. 5, a reinforcing wire member 33 is secured between adjacent side arms 31' and 32' and defines a bridge section 34 extending substantially transverse to the side arms 31' and 32'. These bridge sections 34 constitute bearing surfaces which rest on the top edge 30 of the two opposed side walls 18 when the containers are stacked one on top of the other in their erected condition.

As shown in FIG. 6, and for the construction of a heavy duty container, the leg member 12 may be provided with a reinforcing steel plate 35 which is shaped whereby to be secured in two sections thereof between opposed spaced side arms of each U-shaped member. A bridge plate section 36 extends between the two U-shaped members and constitutes the bearing surface which will rest on the top edge 30 of the two opposed side walls 18 of the container, when stacked thereon. As can be seen in FIGS. 5 and 6, one or both of the U-shaped members may be outwardly flared at an end section thereof to facilitate guiding the bearing surfaces of the leg members onto the top edge of the side walls 18.

As shown in FIG. 5, the top edge 30 is shaped to provide a guide means for the leg members 12. This guide means is constituted by a shoulder portion 40 formed at each end of the top edge 30 and disposed lower than the top edge 30. Thus, the top edge defines an elevated longitudinal central section 41 (see FIG. 8) having opposed end connecting edges 42 elevated and sloping to a respective shoulder portion 40 to prevent lateral displacement of the legs 12 of a further container resting on the shoulder portions 40.

When the containers have their side walls collapsed thereon, there is provided a guide means to facilitate stacking of such containers one on top of the other. This guide means is shown in FIG. 5 and constituted by two spaced-apart wire members 43, being extensions of the side arms 31' of the U-shaped member 31. These extension portions 43 extend above the top edge 44 of the upstanding wall 13 and in alignment with each of the legs 12 to receive the bearing members 34 of a respective leg member of a further container resting on the top edge 44. By bending these extension portions 43 outwardly, it is easier to guide the bearing members 34 therebetween as these will be displaced sideways if they touch a sloping surface of the members 43.

Referring now to FIGS. 1 and 6, there is shown a securing means 50 to secure the bottom horizontal edge 51 of the two opposed collapsible side walls 18 in alignment with the top edge 44 of an adjacent upstanding wall 13. As shown in FIG. 1, the securing means 50 is constituted by a hinged clamp 52 secured to the upstanding wall 13. A hook member 53 engages a lower edge portion, herein a structural wire member 9, of the bottom horizontal edge or adjacent the bottom horizontal edge 51 of the side wall 18. As shown in FIG. 6, the securing means 50 is herein constituted by a U-shaped guide member 54 received between spaced-apart structural wire members 9' and 9''. In this particular embodiment, the vertical structural wire members 9''' are secured on the outside of the wire members 9'' to provide a guide channel 55 therebetween. The U-shaped extension 54 is received within the guide channel to maintain the side wall 18 in alignment.

Figure 7:
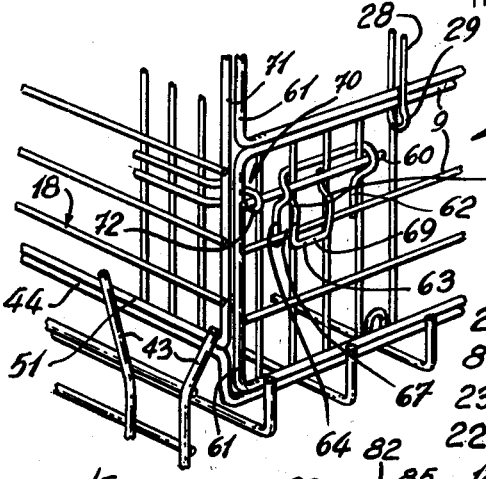
FIG. 7 is a fragmented perspective view showing the connecting means of the front wall with a side wall of the container.

Referring now to FIG. 7, there is shown the construction of the connector member 26. As hereinshown, the connector member 26 is constituted by a sliding locking pin 60 secured adjacent a side edge 61 of each collapsible front wall section 22 and 23. The pin 60 is trapped within a frame member 62 secured to structural wire members 9 and permitting axial sliding movement of the locking pin 60 therein. A handle member 63 restricts the axial displacement travel of the pin 60 between opposed spaced parallel stop members 64. The handle member 63 is a U-shaped bracket having side arms 65 of S-shaped cross-section with the upper end 66 thereof extending to one side of the pin 60 while the bottom end 67 extends substantially below and forwardly on an opposite side of the pin 60. Thus, when the handle member 63 is in the position as shown in FIG. 7, the top end 66 will abut against one of the vertical wire members 9, herein wire member 68, and closely spaced to one of the side members 64, whereby to prevent axial displacement of the locking pin 60. Thus, the locking pin 60 is in a locked position and to displace it, it is necessary to lift the handle member 63 from the bottom end 69 thereof and pull the pin 60 axially. A loop member 70 extends from a front vertical edge 71 of each collapsible side wall 18 in alignment with a respective locking pin 60 to receive a free end of a pin 60 in the loop end 72 thereof whereby to interlock the front wall sections 22 and 23 to the side walls 18 with the vertical edges 61 and 71 in side-by-side alignment. Thus, all of the collapsible side walls are interlocked in their vertical positions by the connector members 26.

Figure 8:
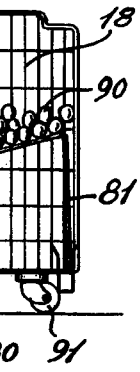
FIG. 8 is a sectional side view of a container illustrating a collapsible bottom wall secured above the bottom support wall.
Figure 9:
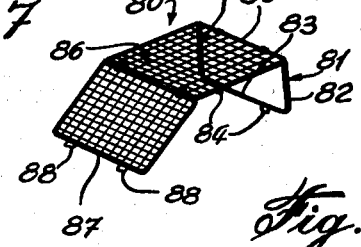
FIG. 9 is a perspective view of the collapsible bottom wall.

Referring now to FIGS. 8 and 9, there is shown the construction of a collapsible bottom wall 80 which is adapted to be hingeably secured on the bottom support wall 11. The collapsible bottom wall 80 is provided with a first section 81 consisting essentially of a U-shaped wire frame having opposed side sections 82 and an interconnecting bottom section 83. U-shaped clamps 84 interconnect the wire section 83 to a wire member at an end edge of the bottom wall 11 and preferably the end edge adjacent the rear wall 14. The top ends of the side sections 82 are hingedly connected to a rear edge 85 of a two-section hinge wall 86. The hinge wall 86 is provided in two sections hingedly connected to each other. The front edge 87 of the hinge wall 86 is provided with wire extensions 88 which engage between wire members 9 near the front edge of the bottom wall 11, as shown in FIG. 8. Alternatively, these wire extensions 88 can be positioned between wire members 9 in the bottom rectangular wall section 22 of the front wall 20 as shown in phantom lines at 89. The purpose of this collapsible bottom wall is to provide a false bottom whereby to stack goods such as produce as shown at 90 in FIG. 8, thus giving the appearance that the container 10 is filled with a great number of the items 90. This collapsible bottom wall 80 also permits better ventilation of the items 90, if such is necessary.

As shown in FIG. 8, casters 91 may be secured to the bottom wall 11 and protrude sufficiently below the support surface or members 31'' of the leg members 12. The projection beyond the support surface 31'' is such as not to interfere with the collapsible side walls of a container on which it is supported in a stacked arrangement.

If the container 10 is to be used to carry very heavy articles, it can be reinforced by making the bottom wall of three separate layers of cross-structural wire members. Also, the side walls can be solidified with further wire members in the area of the leg members. Furthermore, sheet material can be attached to the side walls or the bottom wall, if necessary. A top wall could also be hinged to the top edge of the back wall if a complete enclosure is required. This can be done whilst maintaining the functionality of the stacking feature of the invention.

The above description relates to examples of the preferred embodiment of the present invention and any obvious modifications thereof falling within the ambit of the claims appended hereto are intended to be covered.

I claim:

1. A stackable material handling container comprising a bottom support wall, opposed pairs of leg members on opposite sides of said bottom support wall, each of said leg members having a support surface spaced downwardly of said bottom support wall and an intermediate bearing surface spaced between said bottom support wall and said support surface, a rigid upstanding wall secured to a marginal edge of said bottom support wall and extending thereabove across said pairs of leg members, guide means on a top edge of said upstanding wall to position said bearing surface of each of said leg members of a further container in a respective support edge section of said top edge whereby containers may be stacked in alignment one on top of the other, a collapsible side wall extending upwardly from a respective peripheral edge of said bottom support wall, said leg members extending a predetermined distance below said bottom support wall to prevent obstruction between said side walls collapsed on said bottom support wall of a container on which said leg members are resting when containers are stacked one on top of the other, said bottom support wall and said collapsible side walls being made of structural wire members welded together, said leg members having two opposed spaced U-shaped members defining side arms and an interconnecting arm, said side arms being connected to said bottom support wall and said upstanding wall, a bottom portion of said side arms being angulated outward from each other, said interconnecting arm constituting said support surface, said side arms connected to said upstanding wall extending above a top edge of said upstanding wall and disposed angularly outwards in the plane of said upstanding wall to constitute a downwardly tapering groove having an open mouth substantially wider than the span of said support surface of said leg members to guide a respective one of said leg members so that said bearing surface will rest on said top edge between said side arms when folded containers are stacked one on top of the other.

2. A container as claimed in claim 1 wherein said connecting means is a sliding locking pin displaceably secured adjacent opposed vertical edges of each wall section, a pair of spaced-apart hooks extending from a front vertical edge of said two opposed collapsible side walls in alignment with a respective locking pin to receive a pin portion in a loop end thereof to interlock said wall sections therewith, said pin being retained for sliding axial displacement on a front face of said wall section, a handle member having side arms secured to said pin at a top portion thereof, said top portion lying in the same plane as said wall section for engagement in said wall section to prevent axial displacement of said pin, said top portion being displaceable away from said wall section by arcuate upward displacement of said handle member in a plane transverse to said pin.

3. A container as claimed in claim 2 wherein a rear collapsible side wall is hinged at a bottom horizontal edge to a peripheral edge of said bottom support wall, two opposed collapsible side walls each hinged along a vertical edge to a respective vertical edge of said rear collapsible side wall, a front collapsible side wall hinged at a bottom horizontal edge to a peripheral edge of said bottom support wall opposite and parallel to said bottom horizontal edge of said rear collapsible side wall, and connecting means to connect said front collapsible side wall to said two opposed collapsible side walls.

4. A container as claimed in claim 3 wherein said two opposed collapsible side walls have a bottom horizontal edge retainable in alignment with said top edge of a respective upstanding wall by retaining means.

5. A container as claimed in claim 4 wherein said retaining means is a hinged clamp secured to each upstanding wall, a hook member on said clamp engageable in a lower edge portion of said bottom horizontal edge of a respective one of said two opposed collapsible side walls to apply downwardly clamping retention of said lower edge portion.

6. A container as claimed in claim 4 wherein said retaining means consists of a guide channel formed in said top edge of said upstanding wall, said guide channel receiving said bottom horizontal edge of a respective collapsible side wall therein and in alignment with said top edge.

7. A container as claimed in claim 3 wherein said front collapsible wall is provided with a bottom rectangular wall section and a top rectangular wall section hinged along a lower edge to a top edge of said bottom rectangular wall section, there being a connecting means associated with each wall section.

8. A container as claimed in claim 7 wherein said lower edge of said top wall section is hinged to said top edge of said bottom wall section by an offset loop member secured adjacent said lower edge of said top wall section, said loop member receiving a top horizontal wire of said top edge of said lower wall section therethrough whereby said top wall section will hinge and rest in front of said bottom wall section and substantially flat thereon.

9. A container as claimed in claim 2 wherein a reinforcing metal plate is secured between said side arms and defines a bridge plate section between said opposed spaced U-shaped members, said bridge plate constituting said bearing surface.

10. A container as claimed in claim 2 wherein a reinforcing wire member is secured between adjacent side arms of said opposed spaced U-shaped members and defines a bridge section extending substantially transversely thereto, said bridge section constituting said bearing surface.

11. A container as claimed in claim 2 wherein at least one of said U-shaped members is outwardly flared at an end section thereof.

12. A container as claimed in claim 2 wherein said guide means is constituted by a shoulder portion formed at each end of said top edge and disposed lower than said top edge, said top edge having an elevated longitudinal central section having opposed end connecting edges elevated and sloping to a respective shoulder portion to prevent lateral displacement of the legs of a further container resting on said shoulder portions and to guide said legs onto said shoulders.

13. A container as claimed in claim 2 wherein said guide means is constituted by two spaced-apart wire members extending above said top edge of said upstanding wall in alignment with each said legs to receive therebetween said bearing surface of a respective leg member of a further container resting on said top edge, said spaced-apart wire members forming part of a leg member.

14. A container as claimed in claim 2 wherein there is provided a collapsible bottom wall hingeably secured on said bottom support wall, said collapsible bottom wall having a first section hinged at an end to an edge of said bottom support wall, and a two-section hinge wall section hingeably connected to an opposed end of said first section and detachably connectable to support said two-section hinge wall section elevated from said bottom support wall.

* * * * *